US007437794B2

(12) United States Patent
Massaro

(10) Patent No.: US 7,437,794 B2
(45) Date of Patent: Oct. 21, 2008

(54) MAGNETIC SCRAPER

(76) Inventor: John S. Massaro, 18 Dogwood La., South Pomona, NY (US) 10970

( * ) Notice: Subject to any disclaimer, the term of this patent is extended or adjusted under 35 U.S.C. 154(b) by 371 days.

(21) Appl. No.: 10/988,774

(22) Filed: Nov. 15, 2004

(65) Prior Publication Data

US 2005/0109372 A1 May 26, 2005

Related U.S. Application Data

(60) Provisional application No. 60/523,813, filed on Nov. 20, 2003.

(51) Int. Cl.
*A47L 13/02* (2006.01)

(52) U.S. Cl. ..... 15/236.06; 15/236.05; 15/236.01; 30/172; 209/215; D32/46

(58) Field of Classification Search ..... 15/236.06, 15/236.05; 209/215; D32/46, 48–49; D4/118; 30/169, 172, 173; 119/264
See application file for complete search history.

(56) References Cited

U.S. PATENT DOCUMENTS 856,168 A 6/1907 Lykken
1,696,561 A 6/1928 Alexander
2,634,444 A * 4/1953 Coleman ..... 15/220.2
3,667,544 A 6/1972 Allimon
4,091,579 A 5/1978 Giangiulio
4,574,417 A * 3/1986 Magnasco ..... 15/236.05
4,977,637 A * 12/1990 Demers ..... 15/104.01
5,353,465 A 10/1994 Pierce et al.
5,395,148 A * 3/1995 Jameson et al. ..... 294/65.5
5,515,570 A * 5/1996 Muscroft ..... 15/220.2
6,546,584 B2 * 4/2003 Hobden ..... 15/144.1
6,634,052 B2 * 10/2003 Hanson ..... 15/220.2

* cited by examiner

*Primary Examiner*—Shay L Karls
(74) *Attorney, Agent, or Firm*—Martin Parkinson

(57) ABSTRACT

A magnetic scraper for manually cleaning contaminated surfaces, such as commercial kitchen exhaust duct systems, is disclosed. Two sharpened blades are positioned opposite one another secured to a body portion. An elongated, extendable arm pivotally connected to the body portion allows propelling the scraper blades either forward or backward in any direction over the extended distances imposed by duct geometry. A magnetic base surface provides self position maintenance of the body portion of the magnetic scraper. Precision dimensions over the length of the scraper body portion and the angle of blade placement permits smooth manual degreasing throughout the varying duct configurations.

13 Claims, 3 Drawing Sheets

MAGNETIC SCRAPER

This application claims the benefit of U.S. Provisional Application No. 60/523813, filed on Nov. 20, 2003. This invention relates to scrapers for removing undesirable materials from a surface, and in particular to a magnetically positionable scraper for removing grease collected in ducts.

BACKGROUND

Cleaning procedures for soiled surfaces such as greasy deposits on grills or within ducts employed in commercial kitchen hood systems often rely on manual or power assisted scraping devices and methods. For example, U.S. Pat. No. 856,168, issued Jul. 4, 1907, discloses a cleaning instrument for kitchen utensils having a handle 1 with an attached perpendicularly positioned scraping blade, and oppositely positioned pliable polishing material 21 (FIG. 1). Again, U.S. Pat. No. 1,696,561, issued Dec. 25, 1928, teaches a scraper for flat surfaces. An elongated handle 11 with end hand grip 12 (FIG. 1) is used to manually propel an attached cutting blade 5 (FIG. 2) either towards or away from the operator. In U.S. Pat. No. 4,091,579, issued May 30, 1978, a scraper is disclosed primarily for scraping either grills or griddles. The scraper 20 (FIG. 1) has an elongated shaft 30, a hand grasping end 32, with an end connecting scraping blade 52 and scouring means 48 secured behind a protective barrier wall 38. Further, U.S. Pat. No. 5,353,465, issued Oct. 11, 1994, teaches a scraper apparatus for removing paint or barnacles from surfaces such as the hull of ships. The scraper has an elongated housing 12 (FIG. 1), a hand held member 18, an end mounted scraping blade 50, and a mounting ring to secure to a mounting plate 72 having a magnetic surface 74. U.S. Pat. No. 3,667,544, issued Jun. 6, 1972, discloses a dumbell scraper to be pumped through a flow line and down the tubing of an oil well in order to remove paraffin from the inner surface of the flow line and tubing.

While the above noted scraper devices offer useful methods and tools for dealing with these ubiquitous cleaning procedures, they do not envisage the efficiency, economy, and ease of operation of the present invention.

It is therefore a primary object of the present invention to provide an efficient scraper for removing objectionable materials from a surface.

An additional object of the invention is to provide a double bladed scraper for equally efficient soil removal in either forward or backward motion.

Still another object of the invention is to provide a magnetically positionable scraper.

Yet another object is to provide a manual scraper easily controllable at substantial operator distances from the scraper blades.

A further object is to provide an efficient and economical manually operated double bladed scraper for completely removing grease deposits from commercial kitchen exhaust ducts.

SUMMARY

These objects and others are obtained with the magnetic scraper and method of the present invention.

As noted above manual scraping devices are usually employed for cleaning surfaces such as greasy deposits. This presents a problem for commercial kitchen exhaust ducts wherein the National Fire Protection Association Code 96 decrees that the ducts must be cleaned down to the bare metal. In this case of kitchen exhaust ducts manual scraping is limited to arms length cleaning because the necessary angle needed to apply sufficient pressure to scrape the built-up grease on the walls of the duct is lost as you go further into the ducts. For example, when cleaning a vertical duct at the base of it, you can hold the scraper at approximately a 25° angle. However, when going further up in the duct, the angle is reduced down to where the necessary pressure is lost. This leaves the majority of the duct in an unsafe condition because the built-up grease cannot be removed.

A second method employed for cleaning these ducts is power washing. This is limited to gaining access into the duct, using a gasoline-powered pressure washer with at least 3,000 psi, with 200° F. of heat. These units run outside of buildings, with hoses being dropped down straight, vertical ducts. However, this is rarely the case due to how the ducts must take different twists and turns around encumbrances to exit to the roof. Another problem associated with this method has to do with the huge amounts of water runoff and the laborious task of capturing the water and grease it generates.

It occurred that a manual scraper might still do this cleaning procedure economically and efficiently if two essential conditions were met. First, that the scraper head containing the scraper blades self maintain its position within the duct. Second, that adequate scraping force be easily applied over the necessarily elongated positions imposed by the wide variety of duct systems.

To this end a magnetic scraper has been devised having an aluminum body containing a pair of steel scraper blades secured at opposite ends of the substantially rectangularly shaped body portion, a pair of magnets secured a spaced distance apart at the base of the body portion, and a top mounted threaded swivel handle for securing an extendable arm capable of extending away form the body portion up to 20 feet.

The above described magnetic scraper fulfills the necessary requirements. The built-in magnets allow the aluminum body portion of the scraper to automatically secure itself to the sides of the steel ducts. The extendable arm now easily permits access to all parts of the duct previously difficult or impossible to do at arm's length. The extendable arm can be mounted so as to swivel in any direction, but is preferably mounted substantially perpendicular to the placement to the two scraper blades. A swivel angle of between 0° to 90° for the extender arm provides for operator exertion of equal pressure whether at a 60° angle or in a 0° straight up and down position. Other important aspects of the invention which will be more fully discussed include the placement of the scraper blades a minimum distance apart, with the blades being secured in contact with the surface to be cleaned at an approximate 15° angle to the flat, top surface of the aluminum body portion of the scraper.

With this arrangement the magnetic scraper of the present invention is easily positioned wherever desired, and conveniently manually caused to glide up or down in any direction, removing ribbons of grease to the bare metal as it moves through the duct. Cleaning operations for a wide variety of commercial kitchen exhaust duct systems can now be manually accomplished with significant new convenience and economy than was heretofore available. The magnetic scraper can also be used for a variety of other applications, such as, for example, paint removal from a metal surface in conjunction with applying a liquid paint remover and then scraping it off. And for certain non-metallic surfaces such as wall paper removal wherein the magnetic scraper has a natural tendency to stay against the wall due to the arrangement of the blades.

DETAILED DESCRIPTION

Figure 1:
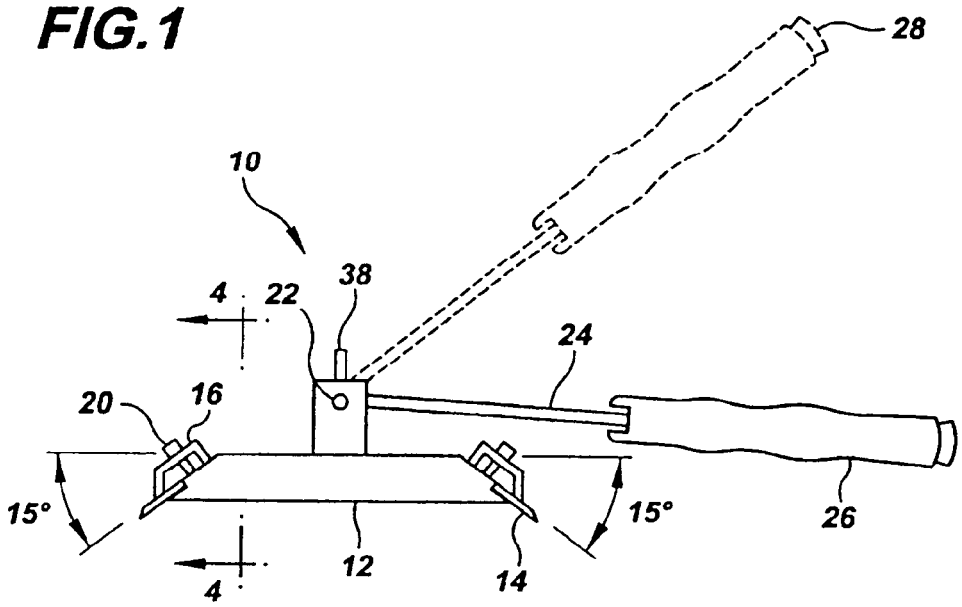
FIG. 1 is a side, perspective view of one version of the magnetic scraper of the present invention, showing an extender arm and handle in phantom depicting motion.
Figure 2:
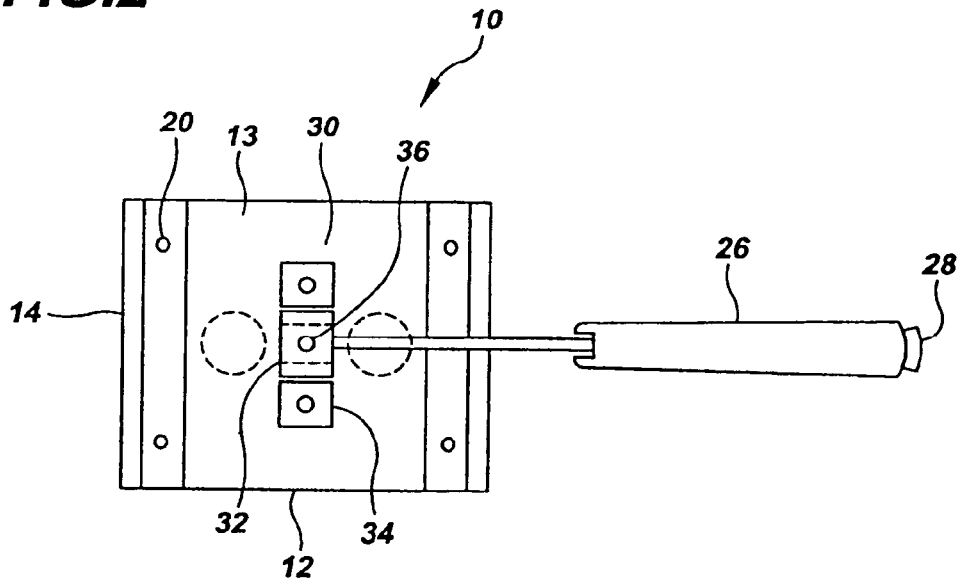
FIG. 2 is a top plan, perspective view of the same version of the magnetic scraper of the present invention shown in FIG. 1.
Figure 3:
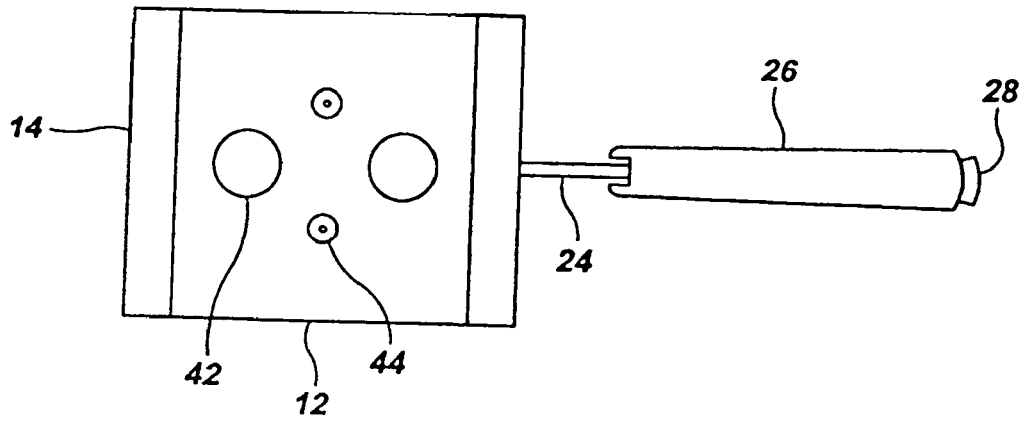
FIG. 3 is a bottom plan, perspective view of the same version of the magnetic scraper of the present invention shown in FIG. 1.

Turning now to the drawings wherein similar structures having the same function are denoted with the same numerals, in FIGS. 1, 2, and 3 one version of the magnetic scraper 10 of the invention is depicted. The basic components of the magnetic scraper 10 comprise a substantially rectangularly shaped aluminum body portion 12 having a front and rear mounted scraper blade 14, and manual means for propelling the aluminum body 12 and scraper blades over the surface to be cleaned, as, for example, a grease soiled commercial kitchen duct system. The aluminum body portion can be fabricated out of a solid aluminum block having a flat top surface 13, left and right sides perpendicular to the top surface 13, and with matching sloped front and rear sides 19 for accommodating the pair of scraper blades 14. Typical dimensions for the aluminum body can be 5½"1×4"w×½" thick.

Figure 4:
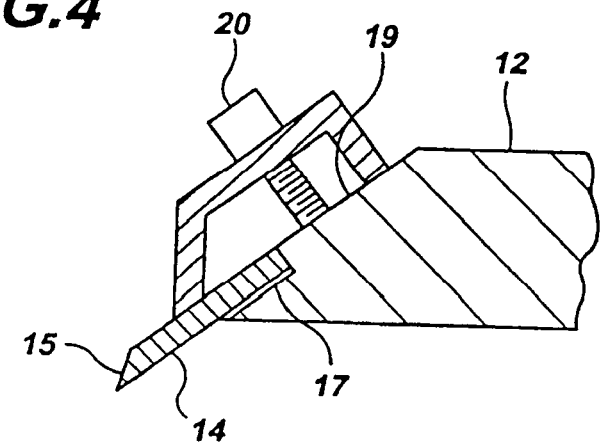
FIG. 4 is a sectional view of one version of a scraper blade assembly, taken along the lines 4-4 of FIG. 1.

As best seen in FIGS. 2 and 4 the pair of scraper blades which can be sharpened edge No.15 blades as, for example, Allway Universal Stripper Blades, Allway Tools, Bronx, N.Y. 10462, is positioned in matching slots 17 fabricated along both ends of the aluminum body. The blades extend approximately ⅜" beyond the front and rear edges adjacent the base of the aluminum body. The slope at each end of the aluminum body subscribes an acute angle of approximately 15° from the top surface 13 of the body to a surface to be cleaned parallel to the flat base of the aluminum body. It is important that this angle be no less than 10°, and no more than 20°, in order to have the magnetic scraper efficiently remove soiled materials. At an angle below 10°, for example, the magnetic pull at the base of the aluminum body will cause the scraper to bind on the surface to be cleaned. And in the case of an angle larger than 20°, this larger angle will again result in binding of the blades during scraping procedures. The scraper blade extends approximately the full 4" width at each end of the aluminum body, secured in place by a blade holder 16 which in turn is set screw 20 secured to the aluminum body.

FIGS. 1, 2, and 3 depict the means for manually propelling the magnetic scraper. As seen in FIG. 2, three aluminum blocks are secured to the center portion of the aluminum body 12, comprising a left aluminum block 34, a middle aluminum block 32, and a right aluminum block 30. A laterally positioned steel swivel pin 22 (FIG. 1) joins all three blocks together A set screw 36 at the top of the middle position block 32 firmly secures an extender arm 24 in place. Set screws 44 (FIG. 3) secure the right 34 and left 30 aluminum blocks to the top surface of the aluminum body 12. Finally, a pair of swing pressure adjusted set screws 38 positioned atop the right and left aluminum blocks (30,34) permit adjustment of the swing pressure.

FIG. 3 illustrates an important feature of the present invention. A pair of circular shaped magnets 42 (high earth magnets-NEO Grade 35) measuring 1"×¼" thick, are placed within matching circular depression a spaced distance apart on the flat base of the aluminum body 12. The magnets may be secured within the depressions in a variety of convenient ways, as, for example, using an adhesive such as an epoxy cement.

Figure 5:
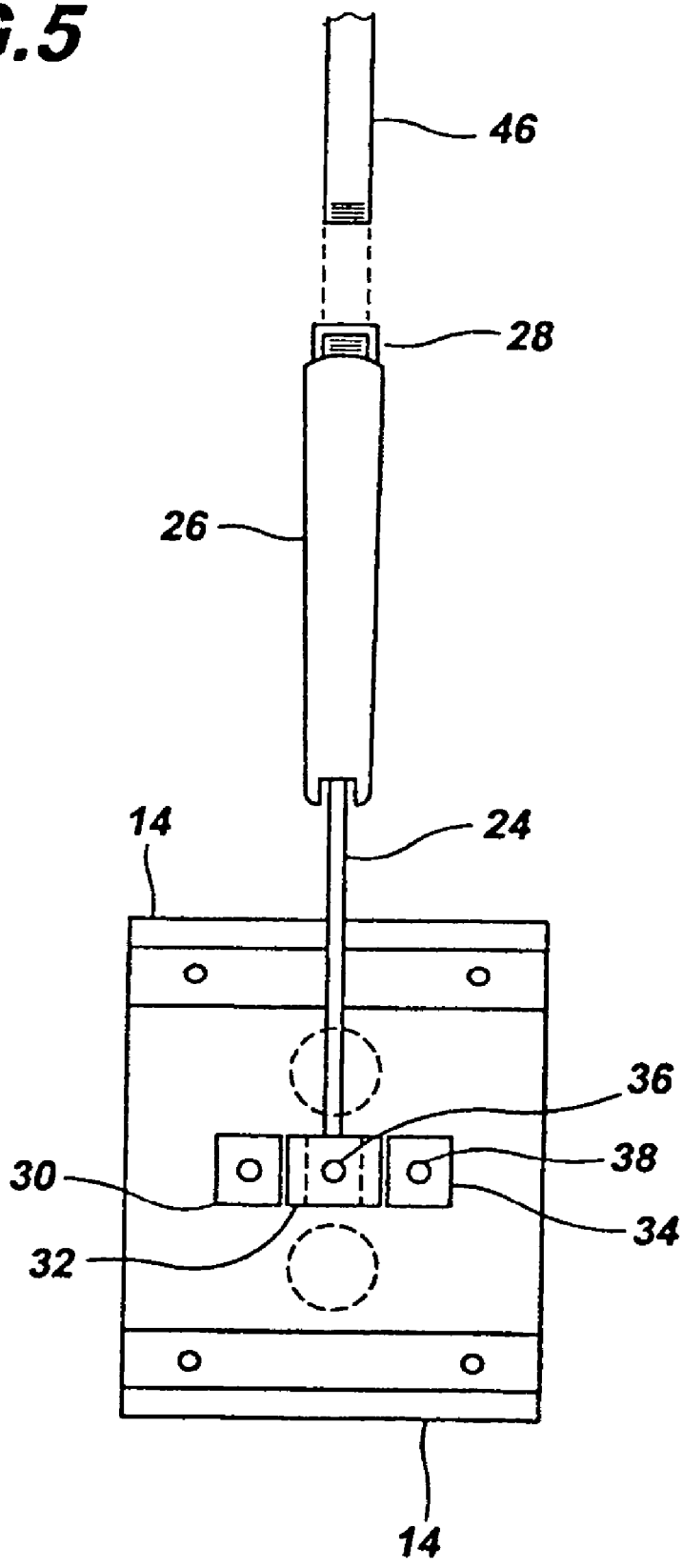
FIG. 5 is a partially sectional, top plan perspective view of the magnetic scraper of the present invention similar to that of FIG. 2, showing an extension arm about to be connected to the handle.

FIG. 5 illustrates yet another advantage possible with the magnetic scraper of the invention. At the free end of the handle a threaded end connector 28 permits coupling an extension arm 46 to a handle 26 on said extender arm 24 by means of matching threads at the end of the extension arm 46. This permits manual operation of the magnetic scraper from a full 20 foot distance from the scraper blades 14.

To operate the magnetic scraper 10 an operator grasps the handle or a portion of the extension arm 46, and positions the magnetic base of the scraper onto a steel surface to be cleaned. With the correctly sized angles of the scraper blades (between 10° and 20°) cooperating with the correctly sized length of the aluminum body 12 (having a minimum length of approximately 4" inches), the magnetic scraper, now magnetically self positioned on the surface to be cleaned, glides smoothly over the surface in any direction, either forward or rearward. As best seen in FIG. 1 in which the handle 26 and extender arm 24 are shown in phantom so as to depict possible motion over approximately 90°, substantially perpendicular placement of the handle 26 and extender arm 24 relative to the edges 15 of the scraper 14 permit maintaining a substantially uniform cleaning pressure over a straight up and down angle of 0° of the handle relative to the top surface 13 of the aluminum body, to as much as a 60° angle.

It is important to note that a variety of changes can be made to the magnetic scraper of the present invention without departing from the scope disclosed herein. For example, the scraper blades can be fabricated in other metals, such as aluminum, or in rigid plastic. While the permissible scraper blade angles are critical, a variety of means may be employed for securing the blades at either end of the scraper body portion. A number of different metals or plastics may be employed to fabricate the aluminum body 12. Different types of magnets can also be utilized at the base of the body to provide secure magnetic attachment. While the preferred means for manually propelling the magnetic scraper are described as a perpendicular placement of an extender arm and handle and threaded extension arm, it would also be possible to have the propelling means swivel over greater or lesser arcs, and have other extender arm extension means, such as, for example, a telescoping arm.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A scraper device for scraping refuse off of a magnetically attracted surface, comprising:

(a) a rigid housing, said housing having a front end, a rear end, a left side, a right side, a top surface, and a bottom surface;

(b) said bottom surface being substantially flat in relation to a surface to be cleaned by scraping;

(c) a pair of rigid scraper bade, said rigid scraper blades being fabricated in metal, each one of said pair of rigid scraper blades being affixed to opposite ends of said housing, said front end and said rear end of said housing being substantially parallel to each other, each one of said pair of rigid scraper blades being affixed to a slope at said front end and said rear end of said housing, said slopes extending downward and oppositely outward from each other, said slopes forming an integral part of said housing, said slopes subscribing an acute angle at each end of said housing, said acute angle having a minimum dimension of 10° and a maximum dimension of 20° between said slope and said bottom surface of said housing;

(d) an extender arm, said extender arm being pivotally affixed at a first end to a center area of said top surface of said housing, said extender arm being positioned substantially equidistant from said left side and said right side of said housing; and (e) at least one magnet being affixed within at least one depression in said bottom surface of said housing.

2. The scraper device according to claim 1 wherein said housing is fabricated in aluminum.

3. The scraper device according to claim 1 wherein said extender arm is pivotable over a substantially 90° arc from a horizontal position parallel to said top surface of said housing, to a vertical position perpendicular to said top surface of said housing.

4. The scraper device according to claim 1 wherein said rigid housing has a minimum length from said front end to said rear end of 4".

5. The scraper device according to claim 1, further comprising means for operator removal and replacement of said pair of rigid scraper blades from said slopes.

6. The scraper device according to claim 1, further comprising a pair of magnets positioned a spaced distance apart being affixed within a pair of said depressions on said bottom surface of said housing, said magnets being positioned along a center line of said housing between said front end and said rear end of said housing.

7. The scraper device according to claim 1 wherein said extender arm has means for adding additional length depending on operator preference.

8. The scraper device according to claim 1 wherein said pair of rigid scraper blades are sharpened edge No. 15 blades.

9. The scraper device according to claim 1, further comprising means for operator adjustment of said extender arm swing pressure.

10. A scraper device for scraping refuse off of a magnetically attracted surface, comprising:

(a) a rigid housing being rectangular in shape, said housing being substantially flat on top and bottom surfaces, said top and bottom surfaces being substantially parallel to each other;

(b) a pair of rigid scraper blades being fabricated in metal, each one of said pair of rigid scraper blades being affixed opposite one another to a pair of oppositely facing slopes at a front end and a rear end of said housing, said slopes extending downward and oppositely outward from each other, said slopes forming an integral part of said housing, said slopes subscribing an acute angle at each end of said housing, said acute angle having a minimum dimension of 10° and a maximum dimension of 20° between said slope and said bottom surface of said housing;

(c) a pair of magnets being secured to said housing, said magnets being positioned a spaced distance apart along an approximately longitudinal center line of said housing, said magnets being secured within a pair of matching depressions within said bottom surface of said housing; and (d) an extender arm having a first end and a second end, said extender arm being affixed at said first end to means for pivoting said extender arm from a horizontal position parallel to said top surface of said housing and equidistant from a left and right side of said housing, to a vertical position perpendicular to said top surface of said housing and equidistant from said left side and said right side of said housing, said pivoting means in turn being affixed to a center area of said top surface of said housing.

11. The scraper device according to claim 10 wherein said housing is fabricated in aluminum.

12. The scraper device according to claim 10, further comprising means for further extension of said extender arm at an operator's discretion.

13. The scraper device according to claim 10, further comprising means for swing pressure adjustment of said extender arm at an operator's discretion.

* * * * *